United States Patent [19]

Pilley, deceased et al.

[11] Patent Number: 4,818,571

[45] Date of Patent: Apr. 4, 1989

[54] METHOD AND APPARATUS FOR APPLYING A BAND OF COATING MATERIAL AROUND A RECIPIENT SURFACE OF AN ARTICLE

[75] Inventors: Terence J. Pilley, deceased, late of Nazeing, by Mervyn H. Pilley, Executor; Fred R. Pilling; Colin A. Tester, both of Bolton, all of United Kingdom

[73] Assignee: Metal Box Public Limited Company, Reading, United Kingdom

[21] Appl. No.: 93,565

[22] PCT Filed: Oct. 6, 1986

[86] PCT No.: PCT/GB86/00598

§ 371 Date: Jul. 15, 1987

§ 102(e) Date: Jul. 15, 1987

[87] PCT Pub. No.: WO87/01971

PCT Pub. Date: Apr. 9, 1987

[30] Foreign Application Priority Data

Oct. 4, 1985 [GB] United Kingdom ..... 8524517
Jun. 14, 1986 [GB] United Kingdom ..... 8614527

[51] Int. Cl.[4] ..... B05D 5/00; B05C 1/00; B05C 1/14

[52] U.S. Cl. ..... 427/286; 118/211; 118/218; 118/219; 118/226; 118/232; 118/257

[58] Field of Search ..... 118/211, 218, 219, 226, 118/232, 257; 427/286

[56] References Cited

U.S. PATENT DOCUMENTS

| | | | |
|---|---|---|---|
| 3,677,801 | 7/1972 | Hardy | 118/233 X |
| 3,695,223 | 10/1972 | Dunham | 118/217 |
| 3,710,753 | 1/1973 | Birchall et al. | 118/230 X |
| 4,275,097 | 6/1981 | Shriver | 118/218 X |
| 4,308,818 | 1/1982 | Abe et al. | 118/211 |
| 4,370,943 | 2/1983 | Watanabe et al. | 118/218 |

FOREIGN PATENT DOCUMENTS

| | | |
|---|---|---|
| 0076134 | 4/1983 | European Pat. Off. . |
| 0130814 | 1/1985 | European Pat. Off. . |
| 0134158 | 3/1985 | European Pat. Off. . |
| 1166207 | 10/1969 | United Kingdom . |
| 1331330 | 9/1973 | United Kingdom . |
| 2047578 | 12/1980 | United Kingdom . |

*Primary Examiner*—Michael Lusignan
*Attorney, Agent, or Firm*—Christie, Parker & Hale

[57] ABSTRACT

Articles such as plastic containers for packaging are given a precisely controlled band of barrier coating material by a moving donor belt or a rotating wheel, the material having been first applied to the belt or wheel, e.g., by a jet such that excess material is removed before application to the articles. The remainder of the article can be coated if desired by another method.

19 Claims, 3 Drawing Sheets

METHOD AND APPARATUS FOR APPLYING A BAND OF COATING MATERIAL AROUND A RECIPIENT SURFACE OF AN ARTICLE

TECHNICAL FIELD

This invention relates to methods and apparatus for the coating of articles by applying a band of coating material around a recipient surface of the article, the article being of curved (circular or otherwise) cross-section and the band being at a predetermined longitudinal position on the article and of predetermined width.

The invention is especially, though not exclusively, applicable to applying coatings to articles such as hollow, rigid or semi-rigid containers, for use in packaging and made of plastics materials, the coatings being of materials for improving the barrier properties of the container. By "barrier properties" we mean partly the ability of the container to resist ingress, through its walls, of air or other gases, micro-organisms or spores of micro-organisms, the object generally being to protect a food or other product subsequently packed in the container from spoilage by oxidation or microbial action for a period sufficiently long to give the product a desired shelf-life. The term "barrier properties" equally means the ability of the container to contain products pressurised above the ambient pressure, such as carbonated beverages, or foods or drinks packed under aseptic (sterile) conditions so that the internal pressure will not be significantly reduced.

Coatings applied by the method or by the apparatus of this invention may have the further or alternative purpose of decoration, for example by providing a coloured opaque or transparent surface.

BACKGROUND ART

Our co-pending U.K. patent application No. 8614527 describes a method of applying a barrier coating, of polyvinylidene chloride (PVdC) for example, to hollow plastics containers or other articles by directing a stream of the liquid coating material against the back surface of a "curtain plate" so that it spreads over the said back surface to fall as a curtain from a lower edge of the plate on to the article to be coated. This is an effective way of coating the greater part of the external surface of the article, but generally an area at the top of the article, above the uppermost level at which the curtain contacts it, remains uncoated.

There is a need for a reliable method of applying coating material in cases where, for example, the whole of the outside surface needs to be covered. Since in general coating material should not contaminate the inside of a hollow article, such a method should apply only as much coating material as is required for the area to be coated (though the amount must be sufficient), and should be able to place it accurately and in such a manner that the material not only remains where it is placed, but is not placed anywhere except where it is required.

Known coating methods such as spray coating, powder coating and flow coating, are too inaccurate for this purpose. Known printing techniques are in general not suitable because the coating materials tend to be more viscous than printing inks and are more difficult to handle. In particular it is desirable to provide as little opportunity as possible for the material to collect on any part of the apparatus and remain there for any appreciable length of time, since is will then coagulate into a solid form difficult to remove.

Known coating materials for which the present invention is suitable include water-based synthetic compounds (now commonly referred to in the trade as "latices"), or solvent-based formulations. Typical compositions of coating materials for improving barrier properties are PVdC, mentioned above and synthetic resins based on ethylene-vinyl alcohols (EVOH).

DISCLOSURE OF INVENTION

According to the invention in a first aspect, a method of applying a band of coating material around a recipient surface of an article of curved cross-section, at a predetermined longitudinal position on the article, the band being of predetermined width, comprises the steps of:

directing a stream of liquid coating material onto a moving donor surface of an elongate donor member while moving the latter along a first path, so as to charge the donor surface with a predetermined quantity of the material;

bringing the recipient surface along a second path into contact with the donor surface while rotating the article so as to present the whole area to be coated to the donor surface; and causing or allowing the band of coating material thus applied to dry.

Preferably, where the article is hollow and has a side wall terminating in an open end defining the upper limit of the band of coating material, the method includes presenting the recipient surface to the donor surface in a mutual orientation from which overhang of the donor surface over the open end of the article is absent.

The method may also include the further step, prior to bringing the recipient surface into contact with the donor surface, of tilting the article so as to orientate the recipient surface to engage the donor surface in a line of contact over the whole band width.

The donor member is preferably in the form of an endless belt, the method comprising maintaining, while the belt is in contact with the article, both the article in said first path and the belt in said second path, in continuous movement while maintaining a constant distance between said paths.

Alternatively, the method may use a said donor surface which, instead of being an endless belt, is formed around the circumference of a wheel rotatable about a fixed axis. The method then comprises the further step of stopping movement of the article in said first path immediately prior to bringing it into contact with the donor surface, and rotating both the wheel and the article while they are brought into mutual contact and so long as they remain in contact, the article being moved away from the wheel after being coated thereby.

After (or before) the method of the invention has been used to apply a band of coating material, the remainder of the recipient surface may be coated with the same or another coating material. Thus, for example, the band may be applied at a first coating station of a machine, the article then passing to a second coating station at which it is subjected to the curtain coating technique mentioned above and described in U.K. patent application No. 8614527. The curtain can be arranged to impinge on the article just above the lower edge of the band, so that there is a slight overlap between the two coated areas. When the coatings are subsequently dried (cured), the appearance will be that of a single continuous coating.

According to the invention in a second aspect, apparatus for applying a band of coating material, by the method of the invention, comprises:

article-carrying means for carrying the article to and away from a coating station and for supporting the article at the coating station;

article rotating means for rotating the article at the coating station;

at the coating station, the donor member, carried by rotatable donor-carrying means, and donor drive means for rotating the donor-carrying means;

means, remote from the path of the article, for directing a stream of liquid coating material against the donor surface; and drying means downstream of the coating station for causing or allowing the band of coating material to dry.

Where the donor member is an endless belt, the donor-carrying means comprise at least two belt pulleys, and the article-carrying means are then arranged to carry the article in continuous forward motion past and in rolling contact with a substantially straight article-engaging course of the belt.

One of the said pulleys will be coupled to the donor drive means. Another may then be mounted with its axis translatable laterally under the control of resilient tensioning means whereby to induce sufficient tension in the article-engaging course of the belt.

In the case of a donor surface around the circumference of a wheel (mentioned above), the donor member is preferably in the form of a tyre, the donor carrying means comprising a wheel mounted for rotation about a fixed axis and coupled with the donor drive means, and the article-carrying means being arranged to index the article to the coating station and to hold it without forward motion for a predetermined time while the article is in contact with the donor surface of the tyre.

Whether or not the tilting technique mentioned above is employed (and whether it is or not will sometimes depend on the shape of the article being coated), the rotatable donor-carrying means may be mounted for rotation in a plane inclined to the horizontal. In this case, preferably, the part of the donor surface which engages the article (e.g. the article-engaging course of a donor belt) is at the upper side, and the area of the donor surface to which coating material is applied is at the lower side so that excess material can fall freely from this area without being carried around by the donor surface or otherwise contaminating the equipment at the coating station.

As to tilting of the article itself, the apparatus may further comprise:

tilting means located upstream of the coating station in the direction of said second path, for tilting the article so that a central axis of the article is tilted from a generally-vertical orientation into an inclination towards or away from the donor surface by less than 90° to the vertical, whereby to orientate the recipient surface to engage the donor surface in a line of contact over the whole width of the band to be applied; and means for maintaining said inclination at least at the coating station.

The donor member may be sufficiently resilient to conform with any changes in contour in the area of the recipient surface to be coated, whereby to make contact with said area over the whole band width.

BRIEF DESCRIPTION OF THE DRAWINGS

Embodiments of the invention are described below, by way of example only, with reference to the drawings filed in this application, in which.

DESCRIPTION WITH REFERENCE TO THE DRAWINGS

Figure 1:
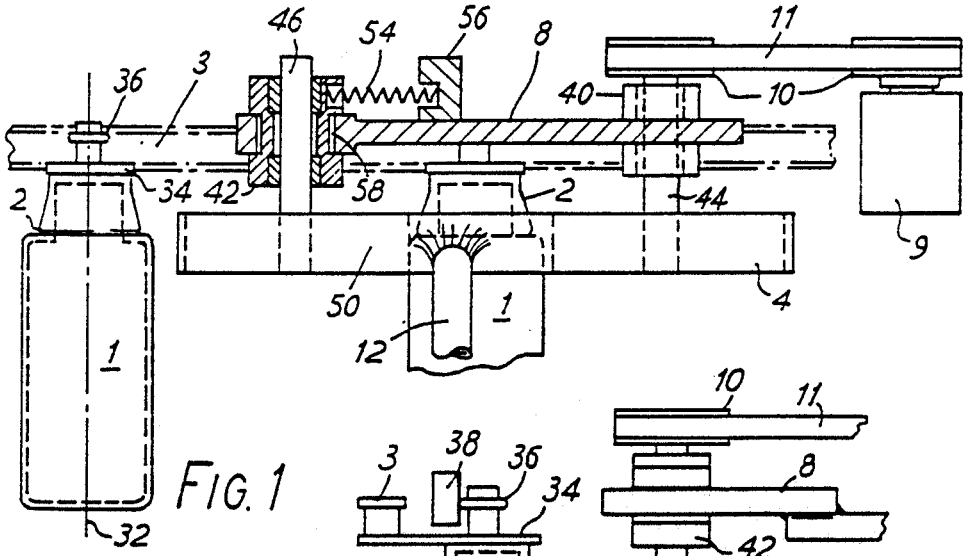
FIG. 1 is a simplified elevation (part of which is in section on the line I—I in FIG. 3) of a coating station of a machine for applying barrier coatings to plastic bottles in a first embodiment of the invention.
Figure 2:
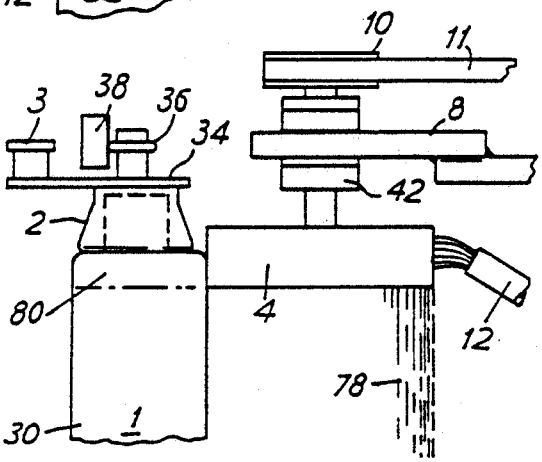
FIG. 2 is a simplified end view from the left-hand side of FIG. 1.
Figure 3:
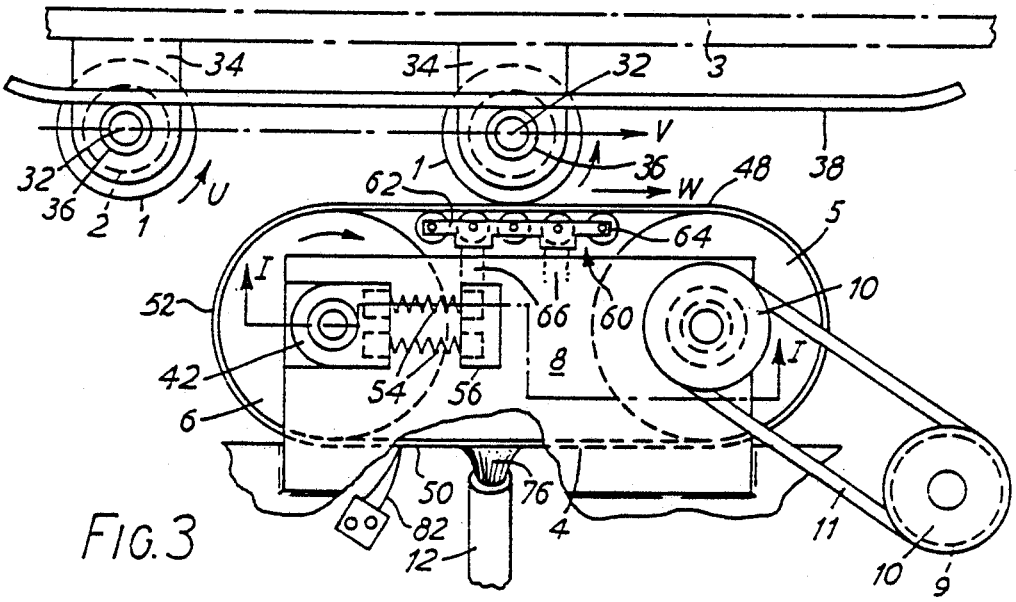
FIG. 3 is a simplified plan on FIG. 1.

The machine of which FIGS. 1 to 3 show a part is a high-speed machine for applying barrier coatings to a succession of bottles 1 made of plastics material. The machine has, among other features, a first coating station which is that shown in FIGS. 1 to 3; a second coating station adjacent to the first station; a draining zone where excess material is allowed to drain from the bottles; and a curing oven in which the coatings are dried and cured. The bottles 1 are carried from a loading station through the first coating station, second coating station, draining zone and curing oven, in that order, to a discharge station by article-carrying means in the form of a continuous chain conveyor (indicated diagrammatically), comprising a chain 3 to which are attached a number of equally-spaced bottle carriers 2.

Only the first coating station is shown in the drawings. The remainder of the machine is preferably as described in U.K. patent application No. 8614527, to which reference is invited, the machine being adapted to accommodate this first coating station. So far as is relevant to an understanding of the present invention, the description and drawings of U.K. patent application No. 8614527 are incorporated herein by reference. However, in this connection it should be noted that the second coating station is optional; if it is provided, its purpose is preferably to coat that part 30, of the sidewall of each bottle 1 that is not coated at the first station; and that coating at the second station may be by any suitable method, e.g. the "curtain" technique described in U.K. patent application No. 8614527, or indeed the method of the present invention. Other alternatives for use at the second station include known methods such as flow or direct-spray coating.

It should also be noted that the carriers 2 can be of any suitable form. Each bottle is held firmly by its carrier throughout its passage through the machine, and means are provided for rotating the bottles about their axes 32 as indicated by the arrow U in FIG. 3, at the coating stations. Preferably this rotation is effected by arranging the bottle carrier 2, for free rotation in a rigid bracket 34 suspended from the chain 3, the carrier having a peripheral rubber drive ring 36, which engages a fixed rail 38 (shown in FIGS. 2 and 3 only).

At the coating station, a mounting plate 8 secured to the machine main frame, carries two bearing blocks 40, 42 in which a pair of pulley shafts 44, 46 respectively are fully rotatable on vertical axes. The lower end of the shaft 44 carries a belt pulley 5, and that of the shaft 46 a belt pulley 6. The upper end of the shaft 44 carries a pulley 10 which is driven through a drive belt 11 by another pulley, coupled to a donor belt drive motor 9.

A donor belt 4 extends around the belt pulleys 5 and 6, and has a straight working or coating course 48 parallel to the chain 3 and running so as to be engaged by the bottles 2. The opposite course of the belt 4, indicated at 50, has a jet 12 arranged to direct a stream of liquid coating material (supplied from a source not shown) against the outer or donor surface 52 of the belt 4.

The donor belt 4 has to be kept under suitable tension, to which end any convenient tensioning device may be used. That shown in FIGS. 1 and 3 comprises a pair of compression springs 54 bearing at one end on a thrust block 56 mounted on the plate 8. The other ends of the springs 54 engage the bearing block 42, which is mounted in an elongated hole 58 in the plate 8 so that its axis is laterally translatable under the control of the springs 54.

A back support device 60 may be provided behind the working course 48 of the belt, to provide a positive, controlled lateral reaction force for engagement of the belt 4 with the bottles 1. In this example, the device 60 comprises a frame 62, carrying a set of free-running rollers 64 and urged toward the belt 4 by resilient elements indicated diagrammatically at 66, which may be mechanical springs or fluid-pressure devices that may be made controllable so as to vary the pressure applied and thus the force exerted by the device 60.

Figure 7:
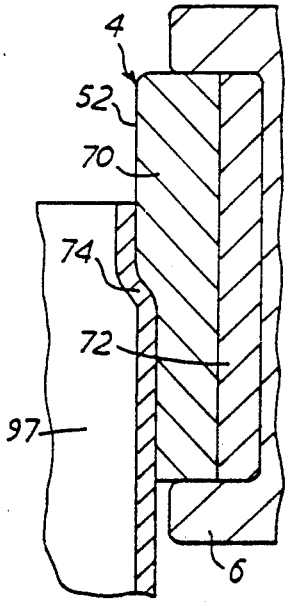
FIG. 7 is a much-enlarged scrap section showing a resilient laminated coating belt in use.

The donor belt 4 may take any convenient form. It should be strong enough to withstand normal forces met in use, and to this end it may be of laminated construction as shown in FIG. 7, with a resilient outer layer 70 mounted on a stout backing layer 72, which is impervious to penetration by the coating material and is typically of a drive belt material. The outer layer 70 is resilient enough to conform, as shown at 74 in FIG. 7, to significant changes in contour of the article 97 being coated. Whether or not the belt is of laminated construction, the donor surface 52, on the outer side of the drive belt, is of a texture capable of holding an even film of the coating material, but the material of which it is made should not be absorbent of the coating material (otherwise the latter, on drying, will clog and stiffen the belt).

In operation, the chain 3 is moved forward at constant speed to convey the bottles 1 along the path V, FIG. 3, to bring it into contact with the donor surface which is being driven at constant speed along a parallel path as indicated by the arrow W. The bottles 1 are kept in continuous rotation by the rail 38. The jet 12 directs a continuous stream of liquid coating material 76 onto the back course of the belt 4, excess coating material falling freely, as indicated at 78 in FIG. 2, to a collecting pan (not shown) below the coating station, whence it is recovered for recirculation.

The belt 4 transfers coating material to the bottle surface 30, on which a band 80 of coating material is thereby applied, to be subsequently dried and cured in the curing oven.

The donor surface 52 will accept an amount of coating material over a given area of the surface up to the maximum which it is capable of retaining. The weight of coating material transferred to a bottle can be predetermined by, for example, providing an adjustable doctor blade 82, FIG. 3, in association with the belt 4.

Figure 4:
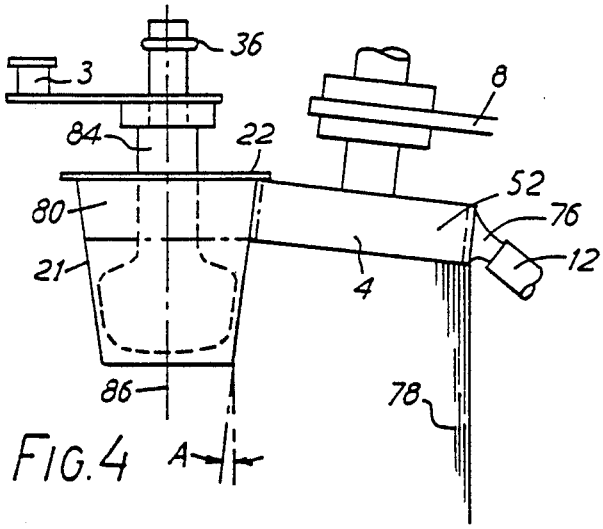
FIG. 4 is a much-simplified view seen in the same direction as FIG. 2 but showing a second embodiment.

FIG. 4 shows a conical plastic pot 21, having its open end surrounded by an integral flange 22. The pot 21 is carried by a pot carrier 84 which may, for example, be of the expanding-jaw kind to grip the inside of the pot by friction. The pot carrier may however be of any other suitable kind. It is freely rotatable in the bracket 34 and again has a suitable means, such as drive ring 36 to cause rotation of the pot 21 about its own axis 86. The pulleys of the drive belt 4 are mounted for rotation in a plane inclined to the horizontal by an angle A which is the half-angle of the cone defined by the port 21 so that the plane of contact, tangental to the outer surface of the pot, between the recipient outer surface of the latter and the donor surface 52 of the belt, is itself inclined to the vertical. Thus the belt applies a band 80 of coating having the same width as the belt and extending downwardly from the extreme upper end of the outer surface of the pot.

Figure 5:
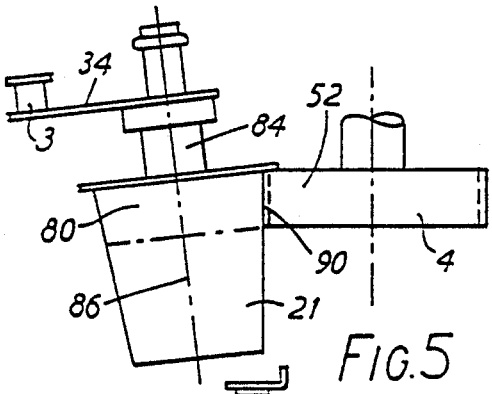
FIG. 5 corresponds to FIG. 4 but shows a third embodiment.

In FIG. 5 the same angular relationship exists between the pot 21 and the belt 4, but in this case the latter is horizontal as in FIGS. 1 to 3, and the axis 86 of the pot is tilted so as to orientate the recipient surface of the pot to engage the donor surface 52 in a line of contact 90 over the whole band width (i.e. the width of the band 80).

Figure 6:
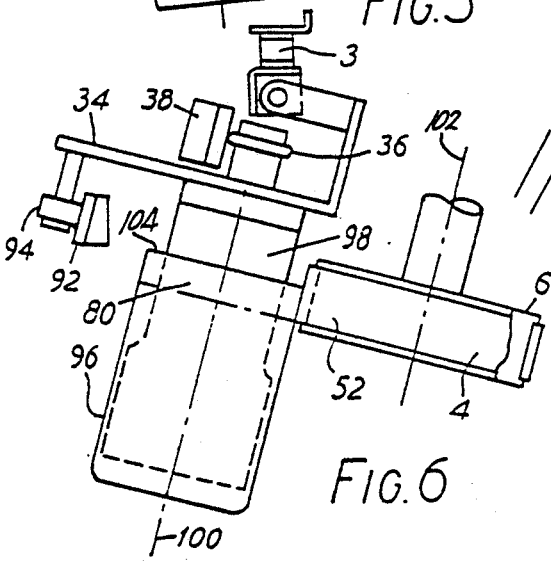
FIG. 6 is another view seen in the same direction as FIG. 2, and shows a fourth embodiment.

The pot is tilted prior to being brought into contact with the belt 4. A means for achieving such tilting is illustrated in FIG. 6, and comprises a fixed rail 92 which engages a follower roller 94 carried by the suspension bracket 34. The rail 92 extends from a point upstream of the coating station, so as to tilt the container 96 of FIG. 6, and continues past the coating station so as to maintain the inclination of the container at the coating station and, if necessary, beyond it.

FIGS. 5 and 6 differ from each other in that the pot 21 in the former is tilted towards the belt 4, whereas in FIG. 6 it will be seen that the container 96 is tilted in the opposite direction. The direction of tilting is determined by suitable location of the fixed rail 92 and of the follower roller 94. The amount of tilting will always be such that the angle of inclination of the recipient surface towards or away from the donor surface is less than 90°.

In FIG. 6, the container 96 is represented as a plain, hollow cylindrical vessel carried by a carrier 98 which may be of a type similar to the carrier 84 in FIGS. 4 and 5. The axis 100 of the container 96, and the axes 102 of the belt pulleys such as pulley 6, lie in parallel planes, both of which are in this case inclined to the vertical. It will be seen that the upper edge 104 of the side wall of the container 96, surrounding the open end of the latter, also defines the upper limit of the band 80 of coating material applied to the belt 4, and is brought into contact with the donor surface 52 intermediate between the upper and lower edges of the belt 4.

By tilting the container and mounting the belt 4 at an inclination away from the container, any possibility of coating material from the exposed part of the surface 52 above the upper edge 104 running down inside the container, is at least reduced.

Figure 8:
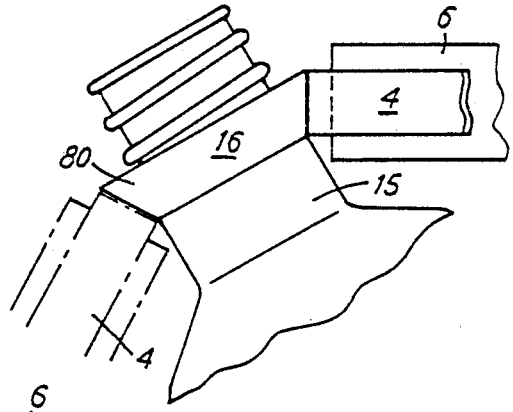
FIG. 8 is a variant on FIG. 7, showing the underside of a bottle flange being coated.

FIG. 8 shows the neck portion 15 of a plastics bottle having a flange 16 with a reversed conical surface which is coated by the belt 4 (the latter being disposed horizontally) by virtue of tilting the bottle in the same manner as is done for the pot 21 in FIG. 4. FIG. 8 also shows in phantom lines an alternative position for the belt 4, steeply inclined and located wholly below the recipient surface of the flange 16.

It will be noted that, in all of the embodiments described herein, the donor surface 52 of the belt 4 is parallel to the plane containing the axes of rotation of the donor-carrying pulleys 5 and 6, at least when the belt 4 (if resiliently compressible as in FIG. 7) is not deformed by contact with the article being coated. However, the belt 4 may be of any required cross-sectional shape.

Figure 9:
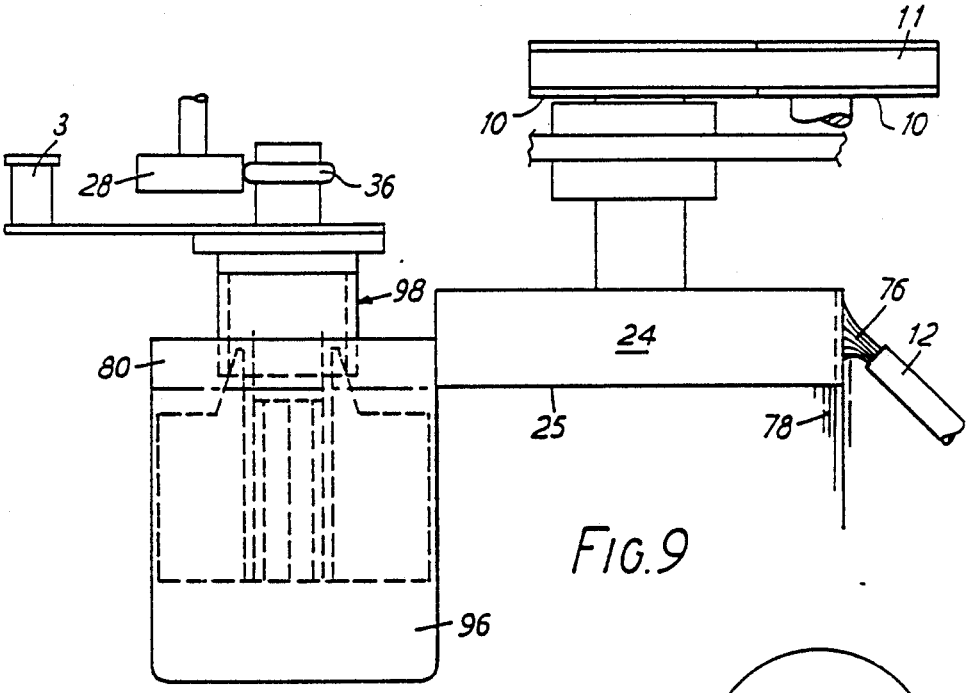
FIG. 9 is a much-simplified end view showing a further embodiment.
Figure 10:
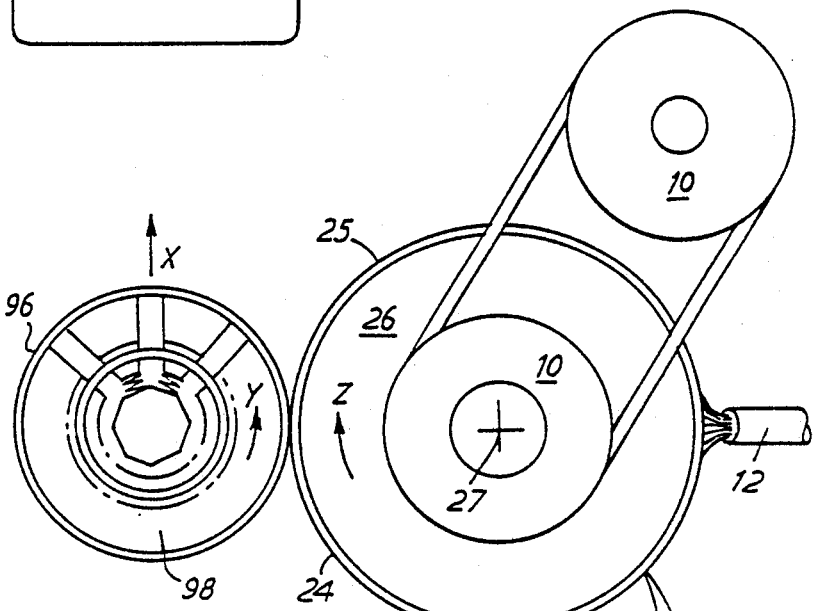
FIG. 10 is a simplified plan on FIG. 9.

Referring now to FIGS. 9 and 10, the container 96 is shown again carried by the carrier 98 which is represented in FIG. 10 as being in the form of an expanding-jaw internal chuck. In this example the axis of the carrier 98 and container 96 is vertical.

Instead of the donor surface being provided on an endless belt, in FIGS. 9 and 10, this surface 24 is the outer surface of a tyre 25 mounted on a wheel 26 which is rotated by the belt drive 10,11,10 about a fixed axis of rotation 27. The jet 12 delivers coating material 76 to the tyre at a point remote from the forward path X of the container 96, and the wheel 26, rotating in the direction of the arrow Z, applies the band 80 of coating material to the container. In operation, the chain 3 is indexed to the coating station, at which it is stopped immediately prior to being brought into full centralised contact with the tyre 25. The container 96 is then rotated by any suitable means (such as a wheel 28 engaging the drive ring 36), and the wheel 26 is also rotated. The rotating container 96 is then finally centred on the tyre, for example, by further movement along the path X, closely controlled by a suitable optical sensing device, and the band 80 is formed. The container is then indexed away from the wheel 26, after which its rotation ceases.

Any suitable indexing system may be employed for controlling the forward movement and dwell time of the chain 3 and the components carried thereby. The thickness of coating material in the band 80 is controlled by setting the predetermined dwell time at the coating station.

In the embodiments described with reference to FIGS. 6, 9 and 10, the article being coated is (by way of example) shown as an open-ended vessel to be coated up to the terminal upper edge of the vessel side wall. It will be noted that in neither case is there any overhang of the donor surface 52 or 24 over the open end. This is important as a general principle to prevent coating material entering a hollow article being externally coated. (The enhancement of this effect in the case of FIG. 6 has aleady been discussed above).

In all of the embodiments described, the remainder of the recipient surfaces, i.e. the outer surface of the sidewalls of the articles below the bands 80, may be coated with material of the same composition as the bands 80 at the second coating station mentioned earlier herein, so that the whole recipient surface, by the time the coating material has been cured, is covered with a continuous coating.

When using a coating material such as polyvinylidene chloride water-based latex, the coating station is preferably (but not necessarily) mounted inside a suitable enclosure having means to control the humidity of the atmosphere within the enclosure and thus minimise water loss by evaporation from the latex.

Rotation of the articles being coated by external means such as the rail 38 or wheel 28 may in some cases be unnecessary, rotation being instead obtained entirely by virtue of free rolling friction between the articles and the donor surface.

INDUSTRIAL APPLICATION

The invention may be applied to any industrial process for the coating of articles of curved cross-section where precise application of a band of coating material is required. A specific example is in the coating of packaging containers of plastics material by a high-speed machine as already described. Another industrial application of the invention resides in the industrial manufacture of apparatus according to the invention.

We claim:

1. A method of applying a band of coating material around a recipient surface of an article of curved cross-section, at a predetermined longitudinal position on the article, the band being of predetermined width, the method comprising the steps of:

directing a stream of liquid coating material onto a moving donor surface of an elongate donor member while moving the latter along a first path, so as to charge the donor surface with a predetermined quantity of the material;

holding the article by a carrier so that the article depends downwardly from the carrier;

using the carrier to bring the recipient surface along a second path into contact with the donor surface and without causing the recipient surface to contact any surface except for the donor surface; while the recipient surface is in contact with the donor surface rotating the article so as to present the whole area to be coated to the donor surface; and causing or allowing the band of coating material thus applied to dry.

2. A method according to claim 1, in which an upper end of the recipient surface is brought into contact with the donor surface, whereby the band extends downwardly from said upper end.

3. A method according to claim 2, in which the upper end of the recipient surface is brought into contact with the donor surface intermediate between the edges of the latter.

4. A method according to claim 3, in which the article is hollow and has a side wall terminating in an open end and defining the upper limit of the band of coating material, and in which the recipient surface contacts the donor surface in a mutual orientation from which overhang of the donor surface over the open end of the article is absent.

5. A method according to claim 1, comprising the further step, prior to bringing the recipient to bringing the recipient surface into contact with the donor surface, of tilting the article so as to orientate the recipient surface to engage the donor surface in a line of contact over the whole band width.

6. A method according to any one of the preceding claims in which said donor member in the form of an endless belt, the method comprising maintaining, while the belt is in contact with the article, both the article in said first path and the belt in said second path in continuous movement while maintaining a constant distance between said paths.

7. A method according to any one of claims 1 to 5 in which said donor surface is formed around the circumference of a wheel rotatable about a fixed axis, the method comprising the further steps of stopping movement of the article in said first path immediately prior to bringing it into contact with the donor surface, and rotating both the wheel and the article while they are brought into mutual contact and so long as they remain in contact, the article being moved away from the wheel after being coated thereby.

8. A method according to claim 1 comprising the further step of coating the remainder of the recipient surface with coating material after the band has been applied.

9. A method according to claim 8 in which said further step of coating the remainder of the recipient surface is effected, using material of the same composition as the band, prior to the step of causing or allowing the band to dry.

10. Apparatus for applying a band of coating material to a recipient surface of an article, comprising:

an elongate donor member having a donor surface;

rotatable donor-carrying means for carrying the donor member at a coating station;

donor drive means for rotating the donor-carrying means;

article-carrying means for carrying the article to and away from a coating station and for supporting the article at the coating station;

said article-carrying means including a carrier for holding the article so that the article depends downwardly therefrom;

said article-carrying means being arranged so that the recipient surface of the article is brought into contact with the donor surface at the coating station without the recipient surface contacting any other surface;

article rotating means for rotating the article at the coating station;

means, remote from the parth of the article, for directing a stream of liquid coating material against the donor surface; and drying means downstream of the coating station for causing or allowing the band of coating material to dry.

11. Apparatus according to claim 10 in which the donor member is an endless belt, the donor carrying means comprises at least two belt pulleys, and the article-carrying means is arranged to carry the article in continuous forward motion past and in rolling contact with a substantially straight article-engaging course of the belt.

12. Apparatus according to claim 11 in which one of said belt pulleys is coupled with the donor drive means, another of said belt pulleys being mounted with its axis translatable laterally under the control of resilient tensioning means for inducing tension in the article-engaging course of the belt.

13. Apparatus according to claim 10 in which the donor member is in the form of a tyre, the donor carrying means comprising a wheel mounted for rotation about a fixed axis and coupled with the donor drive means, and the article-carrying means being arranged to index the article to the coating station and to hold it without forward motion for a predetermined time while the article is in contact with the donor surface of the tyre.

14. Apparatus according to any one of claims 10 to 13 in which the rotatable donor carrying means are mounted for rotation in a plane inclined to the horizontal.

15. Apparatus according to claim 10 in which the donor surface is parallel to a plane containing the axis or axes of rotation of the donor carrying means.

16. Apparatus according to claim 15 in which the rotatable donor carrying means are mounted for rotation in a plane inclined to the horizontal, whereby the plane of contact between the recipient surface of the article and the donor surface is itself inclined to the vertical.

17. Apparatus according to any of claims 10 to 13, 15 or 16, further including:

tilting means located upstream of the coating station in the direction of said second path, for tilting the article so that a central axis of the article is tilted from a generally-vertical orientation into an inclination towards or away from the donor surface by less than 90° to the vertical, whereby to orientate the recipient surface to engage the donor surface in a line of contact over the whole width of the band to be applied; and means for maintaining said inclination at least at the coating station.

18. Apparatus according to any one of claims 10 to 13, 15 or 16, in which the donor member is sufficiently resilient to conform with changes in contour in the area of the recipient surface to be coated, whereby to make contact with said area over the whole band width.

19. Apparatus according to claim 11, including a device for providing a positive reaction force for engagement of the belt with the recipient surface of the article, said device being located beside the article-engaging course of the belt on the opposite of the belt from its donor surface.

* * * * *

UNITED STATES PATENT AND TRADEMARK OFFICE

CERTIFICATE OF CORRECTION

PATENT NO. : 4,818,571

DATED : April 4, 1989

INVENTOR(S) : T. J. Pilley; F. R. Pilling; C. A. Tester

It is certified that error appears in the above-identified patent and that said Letters Patent is hereby corrected as shown below:

Column 10, line 14, after "13" insert -- or 19 --.

Column 10, line 29, after "16" insert -- or 19 --.

Column 10, line 42, change "claims 10 to 13, 15 or 16," to -- claims 10 to 13, 15, 16, or 19 --.

Signed and Sealed this

Twelfth Day of December, 1989

*Attest:*

JEFFREY M. SAMUELS

*Attesting Officer*

*Acting Commissioner of Patents and Trademarks*